US010731377B2

(12) United States Patent
Cassetta

(10) Patent No.: US 10,731,377 B2
(45) Date of Patent: Aug. 4, 2020

(54) BACKPACK SHELTER

(71) Applicant: James Robert Cassetta, Tahoma, CA (US)

(72) Inventor: James Robert Cassetta, Tahoma, CA (US)

( * ) Notice: Subject to any disclaimer, the term of this patent is extended or adjusted under 35 U.S.C. 154(b) by 0 days.

(21) Appl. No.: 15/441,312

(22) Filed: Feb. 24, 2017

(65) Prior Publication Data

US 2018/0347225 A1 Dec. 6, 2018

Related U.S. Application Data

(60) Provisional application No. 62/298,972, filed on Feb. 23, 2016.

(51) Int. Cl.

| | |
|---|---|
| ***E04H 15/38*** | (2006.01) |
| ***E04H 15/02*** | (2006.01) |
| ***E04H 15/30*** | (2006.01) |
| ***A45F 4/02*** | (2006.01) |
| ***A45F 4/04*** | (2006.01) |
| *E04H 15/56* | (2006.01) |
| *A47C 17/64* | (2006.01) |

(52) U.S. Cl.

CPC ..... *E04H 15/38* (2013.01); *A45F 4/02* (2013.01); *A45F 4/04* (2013.01); *E04H 15/02* (2013.01); *E04H 15/30* (2013.01); *A47C 17/64* (2013.01); *E04H 15/56* (2013.01)

(58) Field of Classification Search

CPC ..... A45F 4/04; A45F 4/06; A45F 4/02; E04H 15/02; E04H 15/30; E04H 15/38; A47C 17/64

See application file for complete search history.

(56) References Cited

U.S. PATENT DOCUMENTS

| | | | | |
|---|---|---|---|---|
| 2,531,501 A * | 11/1950 | Cline | A45C 3/10 | 135/116 |
| 2,819,776 A * | 1/1958 | Balsam | A45F 4/04 | 135/904 |
| 4,058,133 A * | 11/1977 | Barr | B60P 3/38 | 135/132 |
| 5,059,463 A * | 10/1991 | Peters | A47G 9/06 | 135/116 |
| 5,941,264 A * | 8/1999 | Gregg | E04H 15/38 | 135/116 |
| 6,349,732 B1 * | 2/2002 | Cooper | E04H 6/005 | 135/116 |

(Continued)

FOREIGN PATENT DOCUMENTS

| | | | |
|---|---|---|---|
| WO | WO-8705067 A1 * | 8/1987 | E04B 1/34357 |

*Primary Examiner* — David R Dunn
*Assistant Examiner* — Danielle Jackson

(57) ABSTRACT

A backpack with incorporated and separable instant tent, sleeping pad, and sleeping bag cover allows the user to carry supplies within an enclosed back pack, which when deployed, becomes a no-set-up lightweight, portable, compactible shelter. The user can enter said structure easily, close it behind him or herself, and access his or her sleeping system and gear within. It may be used by hikers, campers, hunters, fishermen, disaster relief victims, military personnel, emergency rescue workers or anyone in need of a personal, portable, quick access, no set up, combined shelter and gear carrying system which is lightweight, provides privacy, protection from the elements, and ease of use.

6 Claims, 5 Drawing Sheets

(56) References Cited

U.S. PATENT DOCUMENTS

| | | | | |
|---|---|---|---|---|
| 9,580,928 | B1 * | 2/2017 | Currid | E04H 15/644 |
| 2006/0169729 | A1 * | 8/2006 | Reis | A45F 4/04<br>224/154 |
| 2008/0283108 | A1 * | 11/2008 | Torres | E04H 15/38<br>135/149 |
| 2010/0154852 | A1 * | 6/2010 | Trieu | A47C 17/64<br>135/96 |
| 2016/0143451 | A1 * | 5/2016 | Le | A47C 17/70<br>135/126 |
| 2017/0000245 | A1 * | 1/2017 | McDuffee | A45F 4/04 |
| 2017/0112267 | A1 * | 4/2017 | Wu | E04H 15/18 |

* cited by examiner

BACKPACK SHELTER

CROSS REFERENCES TO RELATED APPLICATIONS

This application claims the benefit of Applicants' prior provisional application, Ser. No. 62/298,972, filed on Feb. 23, 2016.

FIELD OF INVENTION

The present invention relates to backpack-tent combinations and to portable, collapsible, freestanding shelters. It has certain specific applications to backpacking, camping, military uses, emergency relief services, and other related activities.

BACKGROUND OF INVENTION

Portable, collapsible, lightweight shelters, such as tents, have been in use for many years. Similarly, backpacks and their like have also been employed as carrying devices for essential equipment and gear. In most cases, collapsible, lightweight shelters consist of tent poles which need to be folded or broken down in such a way as to be small enough to conveniently carry, with a separate fabric covering structure folded or rolled to be contained and carried. Backpacks are generally carried by means of two straps affixed in such a way so that the pack can be easily carried over the shoulders and often include a belt at the waist to balance the load across the hips.

Backpackers, hikers, mountaineers, hunters, and others engaged in outdoor activities have been known to carry all their equipment with them in or on a backpack, often having the essential outdoor survival components of tent, sleeping pad, and sleeping bag carried on the outside of the pack, affixed by ties or other connectors. This can be a cumbersome way to transport a shelter and/or gear and can make setting up a sleeping system in the dark or in inclement weather conditions difficult, inconvenient, dangerous, and potentially hazardous as in the case where the life-saving shelter and warming gear of an individual gets wet from being attached on the outside of the pack, as well as then having to access all the parts of the tent, unpack them, locate the poles and pole sleeves, insert poles, hammer in stakes, etc in order to erect a structure. After that, a person may be able to pull the backpack inside the shelter to access other essential equipment, but in the case of one person tents, often there is only enough room for the person, and not the pack. Many shelters that are intended to be used by a single individual are also not designed for comfort or ease of movement, or provide the individual with enough space to sit up fully.

In addition to use by hikers, campers, hunters, and their like, portable, collapsible, lightweight shelters are required in situations where the need for an instant shelter which can also accommodate an individual's sleeping equipment and other necessities is paramount to survival. Victims of catastrophes, emergencies, and climactic, economic, or social disasters often need temporary shelters which provide relief, protection from the environment, and some degree of privacy. Military personnel who are on the move and need an instant shelter can also benefit from a combined backpack/tent structure that can provide shelter in a trice and can encompass necessary gear. Similarly, individuals who live in geographic areas where mosquito-borne illnesses proliferate can benefit from sleeping within tent-like structures which incorporate mesh netting.

There have been previous attempts to address the need for a combination backpack and tent, as in Rowe U.S. Pat. No. 5,277,349, which utilizes the backpack frame as the support for one end of a tent, Velazquez U.S. Pat. No. 3,971,495, in which a "telescopic tubular frame pulls apart to form the support for the bed in the extended mode and nests together to form a pack frame, in the folded mode", and Smith et al. U.S. Pat. No. 3,931,918, in which the backpack frame forms part of the tent structure. Some combinations make use of a backpack frame to create a cot that can then be covered by a tent, as in Howard U.S. Pat. No. 4,914,768A, however that concept seems to require a lot of set up and restructuring. In Robichaud, U.S. Pat. No. 3,995,649, a compactible shelter that can be erected instantly is conceived of which can be carried in the manner of a backpack, with other necessities attached to the outside of the compactible shelter. In this instance, the rigid, rectangular shape of the frame may make carrying the structure awkward or uncomfortable over long distances. While these inventions do serve to address the need to have a combined backpack/tent, many of them are complex and unwieldy.

It is consequently preferable to have a collapsible shelter which can be carried or transported easily and can be erected instantly upon opening; is lightweight, easy to use, does not need to be disassembled and reassembled into component parts, is easy to manufacture, and can contain and carry essential gear. It is an object of this invention, therefore, to provide an improved combination backpack and instant tent which can shelter an individual in the simplest possible way, provide comfort and privacy, and have room for carrying indispensable equipment.

It is another object of this invention to provide a weatherproof, collapsible structure which can be erected instantly, with no set up, and no modification of the backpack frame.

It is another object of this invention to provide a no set up shelter which has a sleeping system available instantly upon opening and which also provides immediate access to the contents therein.

It is also an object of this invention to provide a no set up shelter that can accommodate an individual in a sitting position, as well as allow room to lie fully extended.

It is a further object of this invention to provide a shelter system with single unit poles of the same size which are flexible and easily replaceable if need be and uses materials that are readily available.

Another object of the invention is to provide a simple, easily fabricated and assembled, backpack with a separable but incorporated no set up portable shelter which can be used effectively for a variety of different purposes and which can easily be stored and transported.

SUMMARY OF THE INVENTION

A backpack tent combination provides a backpack coupled with a portable, foldable shelter comprised of a series of u-shaped staves enclosed within structured fabric sleeve elements connected by a fabric covering on the top, or "tent" portion, and conjoined with a waterproof, padded "floor", or tent bottom, at a section of fabric wall along the entire perimeter of the structure. The floor, or tent bottom, also comprises the two halves of the backpack that are folded and unfolded in the manner of a clamshell.

The u-shaped staves connect on either side of the tent structure to a circular central hub on either side. The circular central hubs are molded or folded into a 90 degree angle across the diameter and serve to join the u-shaped staves to a connecting panel. The semi-rigid, flat connecting panel serves to keep the stave hubs at a constant distance to provide tension to the u-shaped staves in such a way as to maintain the structural integrity of the arced staves.

The tent structure attaches to the backpack both along the bottom of the backpack, uniting with the upper face of the hub connecting panel, and along the outside of both sides of the zippered halves of the backpack by means of Velcro type hook and loop closure. The clamshell shape of the backpack when folded allows the tent to be compactible along a plane, and when opened, to provide the base structure for the half-dome shape of the fully opened tent. A zippered opening is incorporated into one of the tent panels to allow ease of access in and out of the tent structure without disrupting the tent/pack connection.

The interior of the backpack/tent shelter has a several inch high fabric wall around the entire perimeter of the floor which serves as both the base and attachment point of the tent structure on the outside and also provides structure for the internal volume of the backpack when folded and zipped around it's perimeter. The interior top of the fabric wall has a fabric sleeping bag cover attached around the inside perimeter of the upper edge of the fabric wall, excepting one arced portion where a person would rest their head, so that a person can insert a sleeping bag, blanket, or other personal covering under this sleeping bag cover. This feature both provides some structure to the pack when folded and allows the user to access their sleeping system immediately upon opening the shelter, without having to unfurl a sleeping pad, sleeping bag, blanket, or other preferred personal system for keeping warm.

The padded "floor" part of the foldable shelter structure, when folded, also serves as the outer covering for the backpack carrying structure for containing personal items and a sleeping system within. The entire unit can be carried upon a person's back in the manner of a backpack, or in any number of configurations, i.e., over one shoulder, with handles, etc. using the various shoulder straps and d-rings.

BRIEF DESCRIPTION OF THE DRAWINGS

Various embodiments of the invention are disclosed in the following detailed description and accompanying drawings.

DETAILED DESCRIPTION AND PREFERRED EMBODIMENT

Numerous specific details are set forth in the following description in order to provide a thorough understanding of the invention. In most cases, a flexible fabric cover which forms some of the tent panels could be constructed of nylon water-resistant material, or a pliable, waterproof membrane such as gore tex. There are also several types of mesh netting, but the specific type used in tents and other insect protection devices is generally extremely lightweight with holes of such a size that a tiny insect could not easily pass through. Similarly, tent poles or staves are generally constructed of aluminum, fiberglass, or other plastic or polymer material. The prototypical embodiment of this invention can use both carbon fiber of fiberglass, but is not limited to those alone. Additionally, the hub connecting member can be made of molded plastic or any other rigid material that can allow for holes to be created to accept the connecting hardware. These are some of the materials used in the preferred embodiment, however, the invention may be practiced according to the claims without some or all of these specific details.

Figure 1:
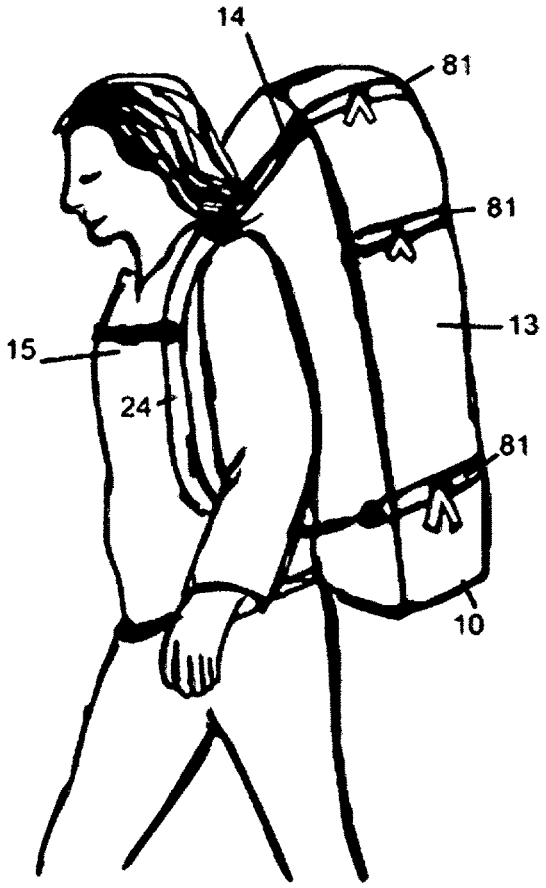
FIG. 1 illustrates an individual wearing the device.

FIG. 1 illustrates an overview of a preferred embodiment when the tent structure is in a collapsed, folded form attached to the backpack 10 and the backpack 10 is in a closed position. The user has the carrying straps 24 configured to tote the device in the manner of a traditional backpack, with weight adjustment straps 14 and 15 creating a balanced load upon the back. A waist adjustment (not shown) may also be used. If necessary the straps could be configured in other ways, for example, to carry the device over a shoulder, across the chest, or by means of handles on the side. D-rings (16 in FIGS. 2, 15) are strategically placed on the outside of the backpack 10 to accommodate different carrying configurations. The unitized tent structure, including tent staves, flexible fabric cover, hub connecting members, hub connecting panel, etc. (see FIGS. 3-10, 14) is attached to the outside and around the upright perimeter of the backpack portion of the backpack shelter and is covered by a waterproof, flexible fabric tent pole cover 13, which is slightly wider than the width of the backpack when in closed position and is attached to the backpack. The tent pole cover 13 is pulled over the structure when the backpack shelter is in closed position. The tent pole cover 13 cinches around the unitized backpack shelter structure by a length of elastic or drawstring encased in the outside edge of the tent pole cover (13 in FIG. 3). Strategically placed ties 81 are used to keep the tent and tent pole cover in place.

Figure 2:
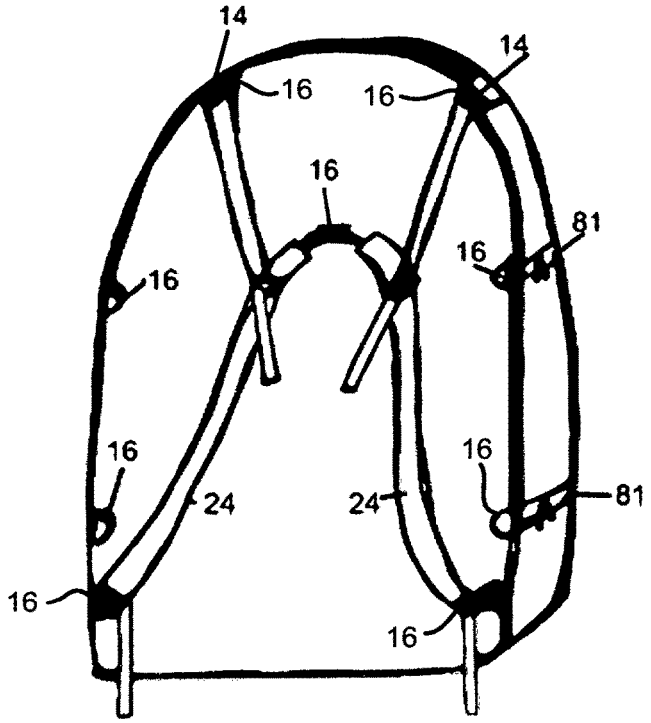
FIG. 2 illustrates an embodiment of the backpack demonstrating the use of shoulder straps in a configuration to be carried on the back.

FIG. 2 illustrates an example of the embodiment shown in FIG. 1, when the device is freestanding and not worn by the user. It demonstrates the carrying straps 24 in a configuration as a backpack carrying mechanism, with weight adjustment straps 14 connected at the top of the pack and carrying straps 24 connected by buckles into D rings 16, with other D-rings 16 not in use. The tent pole cover (13 in FIGS. 1, 3) is in use and cinched by ties 81 to keep the structure of the entire unit tight and contained.

Figure 3:
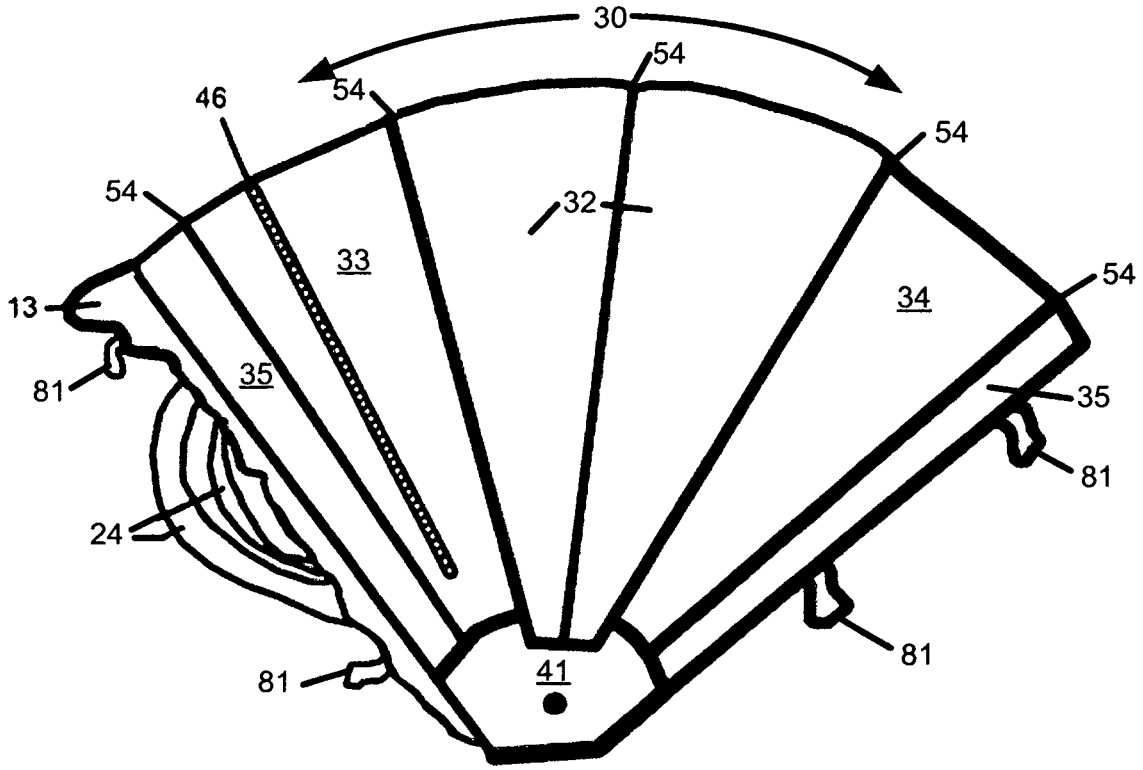
FIG. 3 illustrates the deployment of the shelter when the pack is set upon the ground.
Figure 4:
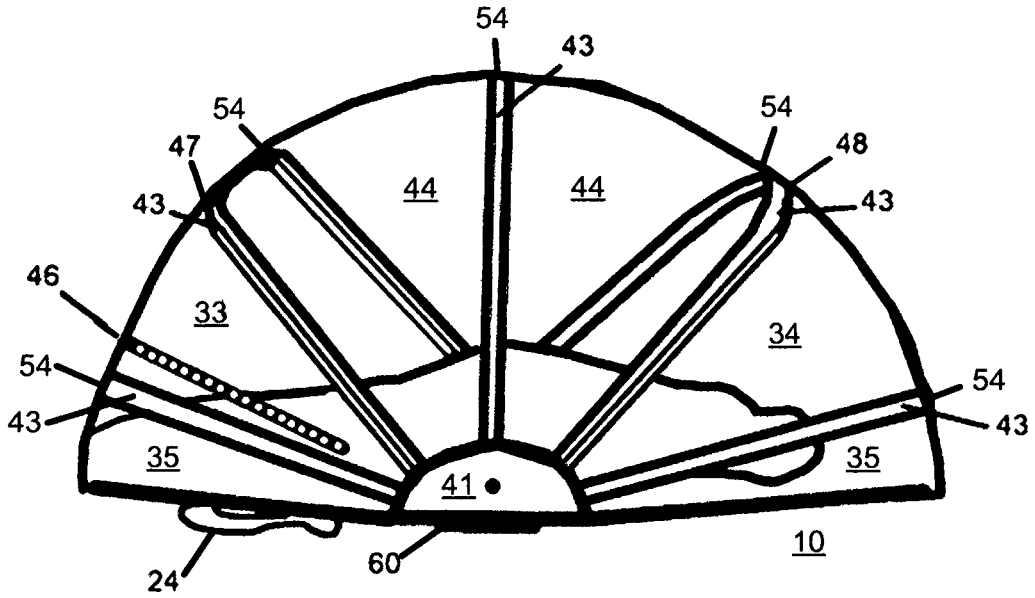
FIG. 4 illustrates an embodiment of the pack open with the shelter deployed and the flexible fabric element fully stretched over the tent stave supporting structure.
Figure 14:
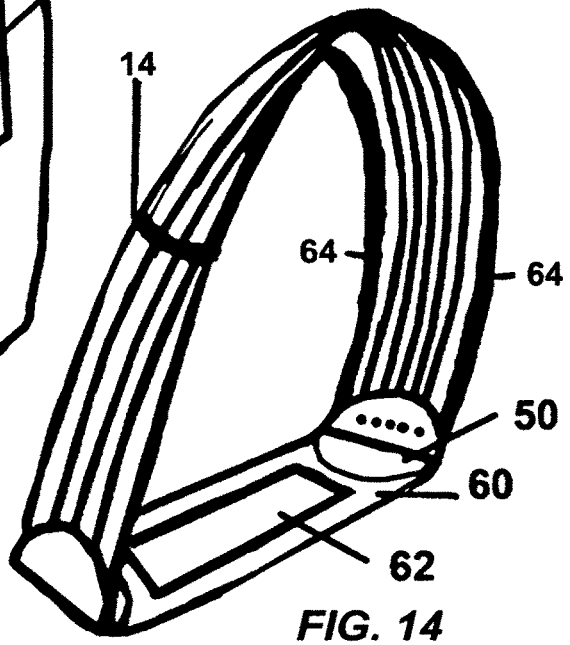
FIG. 14 illustrates the separable tent structure when in the folded, or tent closed, position.

FIG. 3 illustrates the essential opening mechanism 30 of the no set-up backpack shelter, wherein once the tent cover ties 81 are unfastened, the tent pole cover 13 peeled back, the two halves of the backpack clamshell zipper 68 separated (as shown in opened form in FIGS. 11 and 12), and the backpack is set vertically upon the ground or sleeping area, the forces of gravity serve to pull down the opposing sides of the backpack structure and let each opposing side now rest flat upon the ground. The shelter can also be opened when the backpack is at rest upon its strap side or non-strap side by simply pulling the facing side open away from the ground and over, allowing the formerly upward facing side to then rest upon the ground. The fan like arrangement of the tent staves 54 combined with their ability to move rotationally from the hub connecting member (50 as shown in FIGS. 5,6,7,9,10,14), held within the construct of the hub connecting panel (60 in FIGS. 4, 5, 10, 14) and flexible fabric tent body (including water resistant flexible fabric panels 33, 34, narrow water resistant flexible fabric panels 35, half-moon shaped radially flexible fabric member 41, preferable mesh netting tent panels, 44 (as shown in FIG. 4, 10), water resistant rainfly 32, and tent pole sleeves 43 in FIGS. 4, 10) and connected to the backpack shell/tent floor (37 in FIG. 11) enable the shelter to self-erect. Generally, contents inside the backpack shelter and the weight of the user when inside, keep the shelter from needing to be staked or held down from outside the tent. The tent staves 54 are enclosed within tent pole sleeves (43 in FIG. 4, 10) of the tent structure and connected at hub connecting members (50 in FIGS. 5,6,7, 9,10, and 14) on the center of the length of each side of the backpack shelter, which are covered by the flexible fabric member 41 of the tent. The hub connecting panel (60 as shown in FIGS. 4, 10, 14) attached to the bottom of the backpack, is resting upon the ground and provides the structural tension to keep the tent staves in their arced shape. When the device is fully open in shelter mode and is resting upon the ground, the user will be able to enter the shelter by means of an entry zipper 46 installed in one of the water-resistant flexible fabric panels 33 and/or 34. A detachable rainfly 32 is affixed over the two mesh tent panels (44 in FIGS. 4, 10) and attaches by means of lightweight hook and loop closure along the length of both edges of the detachable rainfly 32 to the tent pole sleeves 43 (specifically numbered 47 and 48 in FIG. 4).

Figure 10:
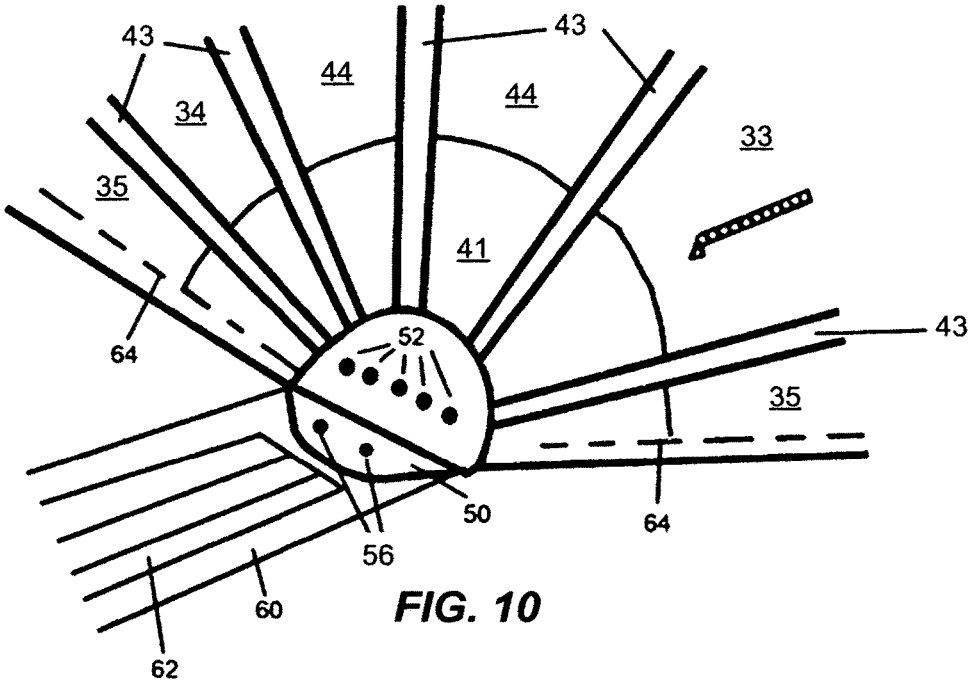
FIG. 10 illustrates an interior view of the tent structure including an abbreviated view of the hub member, hub connecting panel, structures tent staves as sewn with tent panels, and hook and loop edge for connecting tent to backpack.
Figure 11:
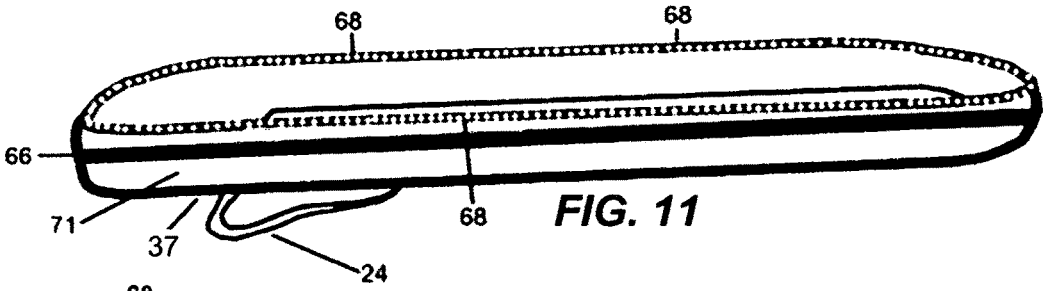
FIG. 11 illustrates the pack open and lying flat.
Figure 12:
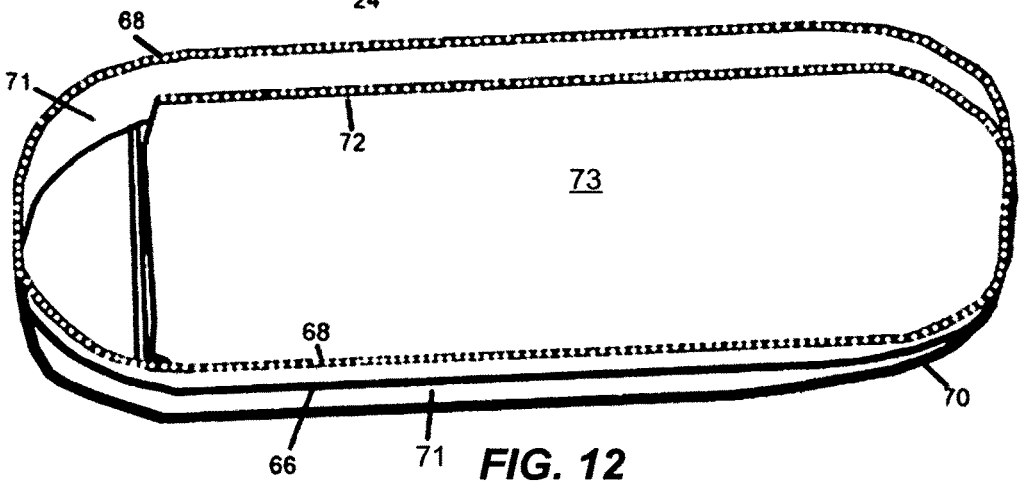
FIG. 12 illustrates the pack open and lying flat with a view of the sleeping bag cover.

FIG. 4 illustrates the backpack shelter device when it is deployed in shelter mode, with a person lying at rest inside and under the attached sleeping bag cover (73 as shown in FIG. 12). The outer shell of the backpack 10 is resting upon the ground with the backpack carrying straps 24 under the side of the device where the feet rest when lying down. The tent is comprised of five tent staves 54 enclosed within tent pole sleeves 43 which help form the structure of the tent. The flexible fabric cover which makes up the body of the tent and serves to keep the tent staves in their uniform arrangement so that they maintain their proper distance when the shelter is erected, is comprised of six panels. Two narrow panels of water resistant flexible fabric 35 are arranged at the bottom of the tent structure, which connects to a supporting flexible fabric wall (71 as shown in FIGS. 11, 12) of the floor and backpack by means of a length of hook side of a hook and loop closure (64 as shown in FIG. 10) affixed along the edge of the inside perimeter of the narrow water resistant flexible fabric panels in order for the shelter structure to connect to the corresponding hook and loop closure on the backpack structure (as can be seen at 66 in FIGS. 11, 12, 15, 16). Two water resistant flexible fabric panels 33 and 34 are affixed along the upper edge of the narrow water resistant flexible fabric panels 35 and conjoined at the length of the tent pole sleeves on either respective side. One water resistant flexible fabric panel 33 accommodates an entry zipper 46, so that the user of the device may enter and exit the shelter without having to disrupt the hook and loop tent/backpack connection (64 and 66 of FIGS. 10, 11, 12, 15, 16). Two other tent panels, preferably constructed of mesh netting 44 are attached along the upper edges of the water resistant flexible fabric panels 33 and 34 and conjoined at the length of the tent pole sleeve structure on either respective side, thus effectively allowing thermal regulation in warmer weather while keeping out mosquitoes, insects and pests. A water resistant flexible fabric rainfly (32 as shown in FIG. 3) is connected by means of hook and loop closures along the length of panels 33 and 34 and extending down to the half-moon shaped flexible fabric tent panels 41 on the center of either side, thereby making a weatherproof shelter. The water resistant flexible fabric rainfly (32 as shown in FIG. 3) extends across the width of the mesh netting panels 44 and along the length of the tent pole sleeves 43 (for purposes of clarification, specifically numbered 47,48) on either side and can be peeled back fully or incrementally to allow for variable ventilation.

Figure 5:
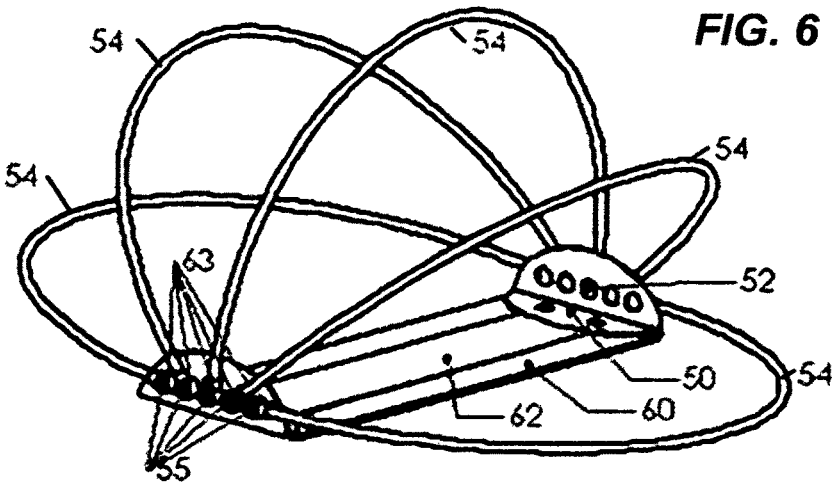
FIG. 5 illustrates a skeletal view of the tent staves and the means by which they are connected to the hub members and the hub connecting panel without the structured fabric stave sleeves and panels.

FIG. 5 illustrates the skeletal tent pole structure, with the tent staves 54 attaching to the hub connecting members 50 on either side of a hub connecting panel 60, which affixes to the bottom of the backpack by means of hook and loop closure 62. The tent staves 54 can move rotationally about the axis of each tent stave connection to the hub connecting member 50. The tent staves 54 are connected to the hub connecting member 50 in such a way as to allow a fan-like movement. This allows the shelter to fold so that all five arced tent staves 54 can join in a plane, as seen in a standing plane in FIG. 14. When the shelter is opened, the specific configuration of the fabric cover and connecting members which form the embodiment of the tent coupled with the configuration of the backpack keep the tent staves 54 in a proper fixed relationship to one another so that the shelter maintains structural integrity.

Figure 6:
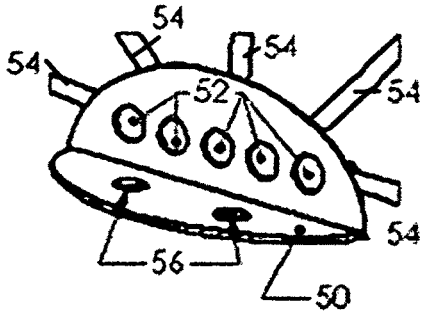
FIG. 6 demonstrates a view of the interior side of the hub connecting panel.
Figure 7:
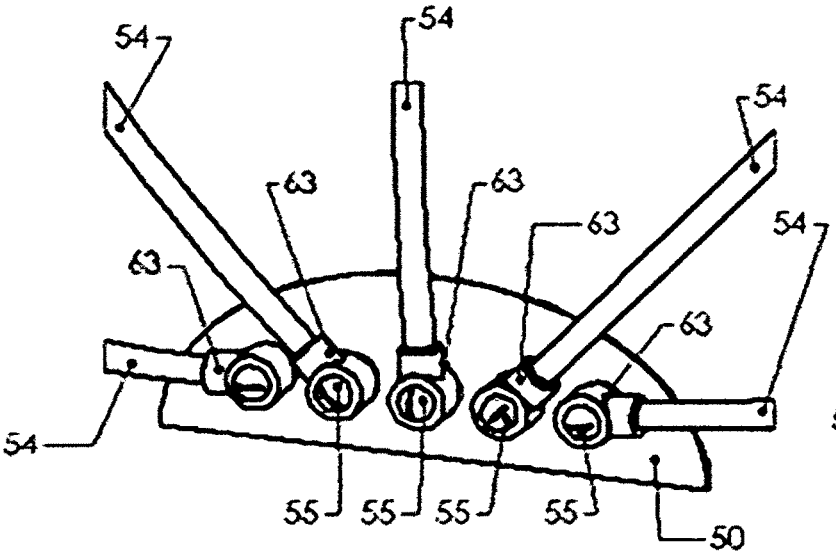
FIG. 7 demonstrates a view of the exterior side of the hub connecting panel.

FIG. 6 shows an expanded view of the interior of the hub connecting member 50 with the tent staves 54 attached to the outside of the vertical plane of the hub connecting member 50 by means of a bolt (55 as shown in FIG. 7, 8, 9) and nut 52 on the interior through receiving holes. The hub connecting panel (60 as shown in FIG. 5) is attached by means of Chicago screws or other hardware at receiving holes 56 on the horizontal plane of the hub connecting member 50.

FIG. 7 illustrates an expanded view of the outer side of the hub connecting member 50 with each of the tent staves 54 inserted into a unit of a receiving hardware terminal 63 which has a tube-like structure on one end that the tent stave 54 is inserted into and an open circle on the other end which can receive a bolt 55. Each bolt 55 is inserted through the open circle of its respective receiving hardware terminal 63 and through a receiving hole in the vertical portion of the hub connecting member 50 then fixed in place by means of tightening each nut (52 as seen in FIG. 5, 6, 9) on the interior of the hub connecting member 50.

Figure 8:
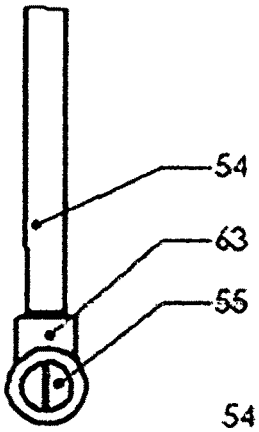
FIG. 8 illustrates the pole connected to a hardware unit which enables the stave to be fastened to the hub member.

FIG. 8 illustrates the receiving hardware terminal 63, which can allow a nut and bolt 55 or other fastener on one end, and the insertion of the tent stave 54 on the other end.

Figure 9:
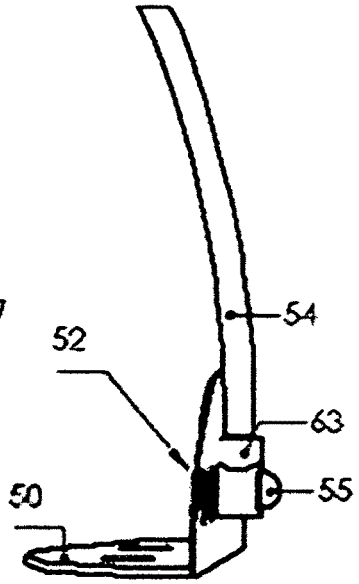
FIG. 9 illustrates a side view of the pole stave and hardware connector fastened to the hub member by means of a nut and bolt.

FIG. 9 illustrates a side view of the hub connecting member 50 which can be made with molded plastic or other rigid material, with the receiving hardware terminal 63 with tent stave 54 inserted on the tube like end of the receiving hardware terminal 63 and nut 52 and bolt 55 affixed therein.

Figure 16:
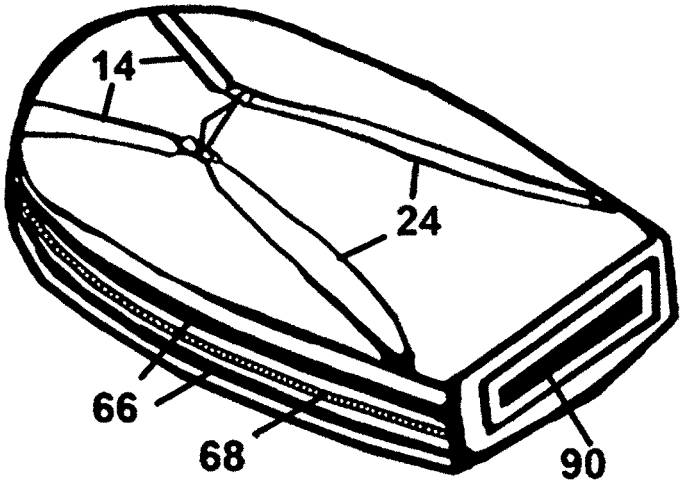
FIG. 16 illustrates the bottom of the outside of the backpack.

FIG. 10 illustrates an abbreviated interior view of the hub connecting member 50, with the hub connecting panel 60 affixed to the horizontal plane of the hub connecting member 50 at the receiving holes 56 by means of Chicago screws or other hardware. The hub connecting panel 60 has a strip of the hook side of hook and loop closure 62 which connects to the bottom of the backpack structure by means of the other section of hook or loop closure (90 as seen in FIG. 16). The tent staves encased within the tent pole sleeves 43 are affixed to the hub connecting member 50 through receiving holes by means of nuts 52 and bolts (55 in FIGS. 5, 7, 8, 9) or other suitable hardware. The skeletal form of the shelter structure is not visible in this figure as it is fully encased within the flexible fabric tent body. The interior view demonstrates the six tent panels (two narrow panels of water-resistant flexible fabric 35, two water resistant flexible fabric panels 34, 33, and two fabric tent panels preferably of mesh netting 44 and 44) affixed to the tent pole sleeves 43 covering and connected at the radially flexible fabric member 41. A strip of the hook side of a hook and loop closure 64 is affixed around the perimeter of the interior lower edge of the narrow water resistant flexible fabric panels 35 of the tent structure, which connects to the partner loop closure on the outside perimeter of the backpack structure (66 as seen in FIGS. 11 and 12).

FIG. 11 illustrates the backpack when in a fully open position, with the backpack straps 24 tucked under the outside of the backpack shell/tent floor 37. The backpack clamshell zipper 68 is fastened along the perimeter of the upper edge of the flexible fabric wall 71 which connects the two sides of the clamshell function of the backpack to secure the necessary contents being carried within (as in FIGS. 15,16). A strip of loop side of a hook and loop closure 66 is adhered to the upper edge of the flexible fabric wall 71 along the outside perimeter of the backpack, which connects to the corresponding hook side of hook and loop closure (64 in FIG. 10) on the interior of the tent structure.

FIG. 12 illustrates the backpack portion of the backpack shelter when in a fully open position and lying flat, with the backpack clamshell zipper 68 affixed around the upper perimeter of the flexible fabric wall 71 and the loop side of the hook and loop closure 66 which connects to the tent embodiment around the outer perimeter of the flexible fabric wall 71 lying below the backpack clamshell zipper 68.

This illustration also demonstrates the fabric sleeping bag cover 73 connected to the upper perimeter of the inside edges of the flexible fabric wall 71 by means of a sleeping bag cover zipper 72 around the edges of the sleeping bag cover. The sleeping bag cover 73 allows the user to access a sleeping system immediately upon entering the shelter without having to unfurl a sleeping bag, blanket, or other warming device and provides some structure to the backpack when folded and zipped. The sleeping bag cover 73 keeps the user's sleeping bag dry and free from debris when other essential items are placed on top of the sleeping bag cover.

Figure 13:
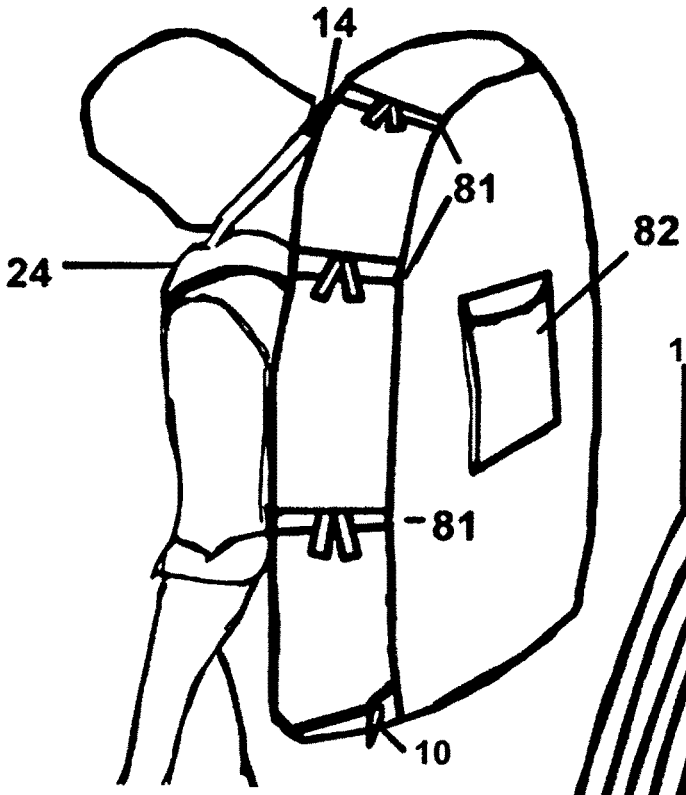
FIG. 13 illustrates the outer tent pole cover.

FIG. 13 shows another view of the device when in backpack carrying mode, with the tent pole cover (13 in FIGS. 1,3) pulled over and cinched around the backpack shelter, ties 81 cinched around the unit, backpack carrying straps 24 with weight adjustment straps 14, and an optional flap pocket 82 which provides quick access to small items.

FIG. 14 illustrates the unitized tent portion of the backpack shelter when folded on a plane and separated from the backpack portion of the backpack shelter device. The tent staves encased within the tent pole sleeves and flexible fabric tent embodiment are gathered in an upright position while connected to the hub connecting member 50 and hub connecting panel 60. The interior of the hub connecting member 50 is visible, along with the hub connecting panel 60 and the hook and loop closure 62 for securing the tent embodiment at the point of contact to the bottom of the backpack embodiment. The hook side of the hook and loop closure 64 which connects the tent structure to the backpack structure is visible along the edge of the interior of the tent structure (see also 64 in FIG. 10). When separated from the backpack, the unitized shelter structure can be held in this position with one of the weight adjustment straps 14.

Figure 15:
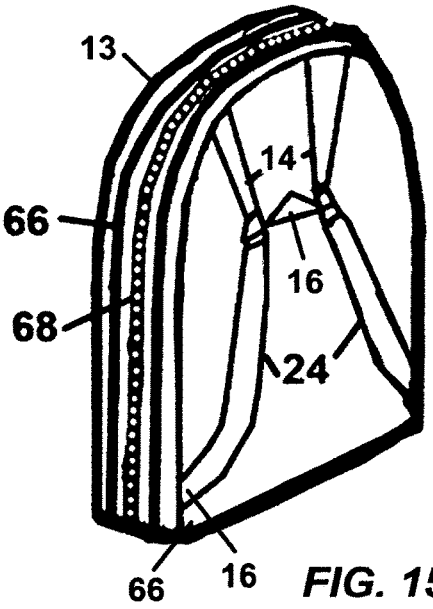
FIG. 15 illustrates the backpack when zipped and separated from the tent structure.

FIG. 15 demonstrates a view of the backpack portion of the device when in a closed and zipped formation and separated from the tent portion of the device. The backpack carrying straps 24, weight adjustment straps 14 and several D-ring connectors 16, are visible, along with the peeled back tent pole cover 13. The backpack has a strip of loop side of hook and loop closure 66 lying along both sides of the backpack clamshell zipper 68. When the backpack and shelter components are united, the loop side of hook and loop closure 66 conjoins to the strip of hook side of hook and loop closure (64 in FIG. 10, 14) which is affixed around the inside perimeter of the tent structure. However, the backpack has other applications when separated from the unitized tent structure, i.e. as a safety or landing pad for climbers.

FIG. 16 illustrates the loop section of hook and loop closure 90 along the bottom of the backpack which connects to the hook and loop closure (62 in FIGS. 5, 10, 14) on the hub connecting panel 60 to help keep the backpack and shelter devices connected together.

The disclosed embodiments are illustrative, not restrictive. While specific configurations of the backpack with incorporated tent, sleeping pad, and sleeping bag cover have been described, it is understood that the present invention can be applied to a wide variety of applications. There are many alternative ways of implementing the invention. The aforementioned is a detailed description of exemplary embodiments to illustrate the principles of the invention. The embodiments are provided to illustrate aspects of the invention, but the alternatives, modifications and equivalents are limited only by the claims.

I claim:

1. A self-structuring backpack tent apparatus comprising:

a first central hub having a first horizontal component and a first vertical component having a first plurality of receiving units, each receiving unit having a stave-insertion opening, a second central hub having a second horizontal component and a second vertical component having a second plurality of receiving units, each receiving unit having a stave-insertion opening;

a hub connecting component having a first end connecting to the first horizontal component of the first central hub and a second end connecting to the second horizontal component of the second central hub;

a plurality of staves between the first plurality of receiving units of the first central hub and the second plurality of receiving units of the second central hub, wherein each stave is inserted in the stave-insertion openings of the first plurality of receiving units and of the second plurality of receiving units, wherein each receiving unit rotates thereby enabling radial movement of the plurality of staves when needed;

a plurality of fabric stave sleeve elements covering each stave;

a plurality of fabric tent panels affixed to the plurality of fabric stave sleeve elements; a floor element having a first surface and a second surface;

a structured wall element that is connected to said floor element and to said plurality of fabric tent panels; and wherein the self-structuring backpack tent apparatus is worn by a person as a backpack and opens to a tent structure when placed on a surface without manual handling by the person of staves or manual insertion by the person of staves into stave-insertion openings.

2. An apparatus as recited in claim 1 further comprising: a plurality of fasteners for fastening the first plurality of receiving units to the first central hub and the second plurality of receiving units to the second central hub.

3. An apparatus as recited in claim 1 wherein the plurality of staves, the plurality of fabric tent panels, and the plurality of fabric stave sleeve elements are collectively cinched to create a backpack form.

4. An apparatus as recited in claim 1 wherein the plurality of fabric tent panels and the plurality of fabric stave sleeve elements keep the plurality of staves in a fixed relationship when the apparatus is in a tent structure form.

5. An apparatus as recited in claim 1 wherein the first surface of the floor element is an outside surface of the backpack and is in contact with ground when in a tent structure form and wherein the second surface of the floor element is a sleeping surface for the person when in a tent structure form.

6. An apparatus as recited in claim 1 wherein the plurality of staves move radially when inserted in the first plurality of receiving units and into the second plurality of receiving units and when the apparatus is re-configured from a backpack form to a tent structure form and when it is re-configured from a tent structure form to a backpack form.

* * * * *